US008857348B2

(12) United States Patent
Gevaert et al.

(10) Patent No.: US 8,857,348 B2
(45) Date of Patent: Oct. 14, 2014

(54) MEDIA STATION INCLUDING TECHNOLOGY BACKBONE AND MAGNETICALLY GANGED TABLE

(71) Applicant: Krueger International, Inc., Green Bay, WI (US)

(72) Inventors: Steven C. Gevaert, DePere, WI (US); Scott A. Bosman, Green Bay, WI (US); Timothy G. Hornberger, Green Bay, WI (US); Nathan Jeske, Green Bay, WI (US); Amy Kiefer, Appleton, WI (US)

(73) Assignee: Krueger International, Inc., Green Bay, WI (US)

( * ) Notice: Subject to any disclaimer, the term of this patent is extended or adjusted under 35 U.S.C. 154(b) by 69 days.

(21) Appl. No.: 13/644,277

(22) Filed: Oct. 4, 2012

(65) Prior Publication Data

US 2013/0092061 A1 Apr. 18, 2013

Related U.S. Application Data

(60) Provisional application No. 61/546,323, filed on Oct. 12, 2011.

(51) Int. Cl.

| | |
|---|---|
| ***A47B 1/00*** | (2006.01) |
| ***A47B 37/00*** | (2006.01) |
| ***A47B 87/00*** | (2006.01) |
| ***A47B 7/00*** | (2006.01) |
| ***A47B 83/00*** | (2006.01) |

(52) U.S. Cl.

CPC ..... *A47B 87/002* (2013.01); *A47B 7/00* (2013.01); *A47B 83/001* (2013.01)

USPC ..... 108/64; 108/50.01

(58) Field of Classification Search

USPC ..... 108/64, 65, 50.01, 50.02, 50.11, 134, 108/135, 152; 312/107, 108, 111, 277, 312/194–196, 223.3, 223.6; 52/36.1, 239

See application file for complete search history.

(56) References Cited

U.S. PATENT DOCUMENTS 1,942,856 A * 1/1934 Davis ..... 312/272.5
2,233,003 A * 2/1941 Epps ..... 312/195

(Continued)

FOREIGN PATENT DOCUMENTS

EP 1 649 783 A2 4/2006
EP 1 649 783 B1 4/2006

OTHER PUBLICATIONS

Canadian Patent Office Action dated Dec. 2, 2013.

*Primary Examiner* — Janet M Wilkens

(74) *Attorney, Agent, or Firm* — Andrus Intellectual Property Law, LLP

(57) ABSTRACT

A media station can be broken-down and reconfigured such that the individual parts of the media station can be used in multiple configurations. The media station includes a central technology backbone that houses the computer hardware and media modules required for the type of monitor/media sharing desired. The technology backbone includes magnetic coupling members that increase the options for the different types of work tables that can be connected to the technology backbone dependent upon the user's needs and the size of the group. The ability to separate the work tables from the central technology backbone allows for flexibility in the styles of table used as well as the potential for cross room cohesiveness and economies of scale in unit types. When the media station is not in use, users can separate the individual work tables from the backbone and use the tables in a conventional manner.

14 Claims, 7 Drawing Sheets

(56) References Cited

U.S. PATENT DOCUMENTS

| | | | | | |
|---|---|---|---|---|---|
| 2,723,171 | A | * | 11/1955 | Carder | 108/64 |
| 3,254,440 | A | * | 6/1966 | Duggar | 446/92 |
| 3,332,373 | A | * | 7/1967 | Ruiz | 108/77 |
| 3,408,127 | A | * | 10/1968 | Vincens | 312/194 |
| 3,437,390 | A | * | 4/1969 | Evans | 312/237 |
| 3,586,409 | A | * | 6/1971 | Cisler | 312/111 |
| 3,714,906 | A | | 2/1973 | Finestone | |
| D239,061 | S | * | 3/1976 | D'Eila | D6/423 |
| 4,047,773 | A | * | 9/1977 | Semany | 312/111 |
| 4,049,331 | A | * | 9/1977 | Gutmann, Jr. | 312/203 |
| 4,103,375 | A | * | 8/1978 | Santo | 5/675 |
| 4,261,122 | A | * | 4/1981 | LeVine | 40/711 |
| 4,382,643 | A | * | 5/1983 | Heinrich | 312/195 |
| 4,400,044 | A | * | 8/1983 | Yoshiyuki | 312/204 |
| D270,690 | S | * | 9/1983 | Daventry | D6/426 |
| 4,886,273 | A | * | 12/1989 | Unger | 273/157 R |
| 4,892,334 | A | * | 1/1990 | Sinclair | 281/45 |
| 5,039,047 | A | * | 8/1991 | Pitzo | 248/206.5 |
| 5,339,747 | A | | 8/1994 | Epps | |
| 5,438,937 | A | | 8/1995 | Ball et al. | |
| 5,628,257 | A | * | 5/1997 | Conner et al. | 108/158.12 |
| 5,794,545 | A | | 8/1998 | McDaniel et al. | |
| 5,906,420 | A | * | 5/1999 | Rozier et al. | 312/223.6 |
| 6,676,231 | B1 | * | 1/2004 | Kelley et al. | 312/107 |
| 6,824,220 | B1 | | 11/2004 | Davison | |
| 7,226,125 | B2 | | 6/2007 | Frobose et al. | |
| 7,250,207 | B1 | * | 7/2007 | Heal et al. | 428/192 |
| 7,347,493 | B2 | | 3/2008 | Mulmed | |
| 7,472,971 | B2 | * | 1/2009 | Schmieder et al. | 312/223.3 |
| 7,926,890 | B2 | * | 4/2011 | Haws, Jr. | 312/108 |
| 8,407,944 | B2 | * | 4/2013 | Baloga et al. | 52/36.1 |
| 2003/0222544 | A1 | * | 12/2003 | Kelley et al. | 312/111 |
| 2005/0200244 | A1 | * | 9/2005 | Rouwhorst | 312/111 |
| 2005/0231080 | A1 | * | 10/2005 | Torrance | 312/223.6 |
| 2005/0274297 | A1 | | 12/2005 | Montague, III et al. | |
| 2008/0042528 | A1 | | 2/2008 | Durand et al. | |
| 2008/0143223 | A1 | * | 6/2008 | Schuller | 312/236 |
| 2009/0095204 | A1 | | 4/2009 | Levy et al. | |
| 2009/0260547 | A1 | * | 10/2009 | Epstein et al. | 108/50.02 |
| 2010/0277043 | A1 | | 11/2010 | Bloch et al. | |
| 2011/0017104 | A1 | * | 1/2011 | DiTrolio | 108/50.11 |
| 2012/0119629 | A1 | * | 5/2012 | Nelson et al. | 312/111 |

* cited by examiner

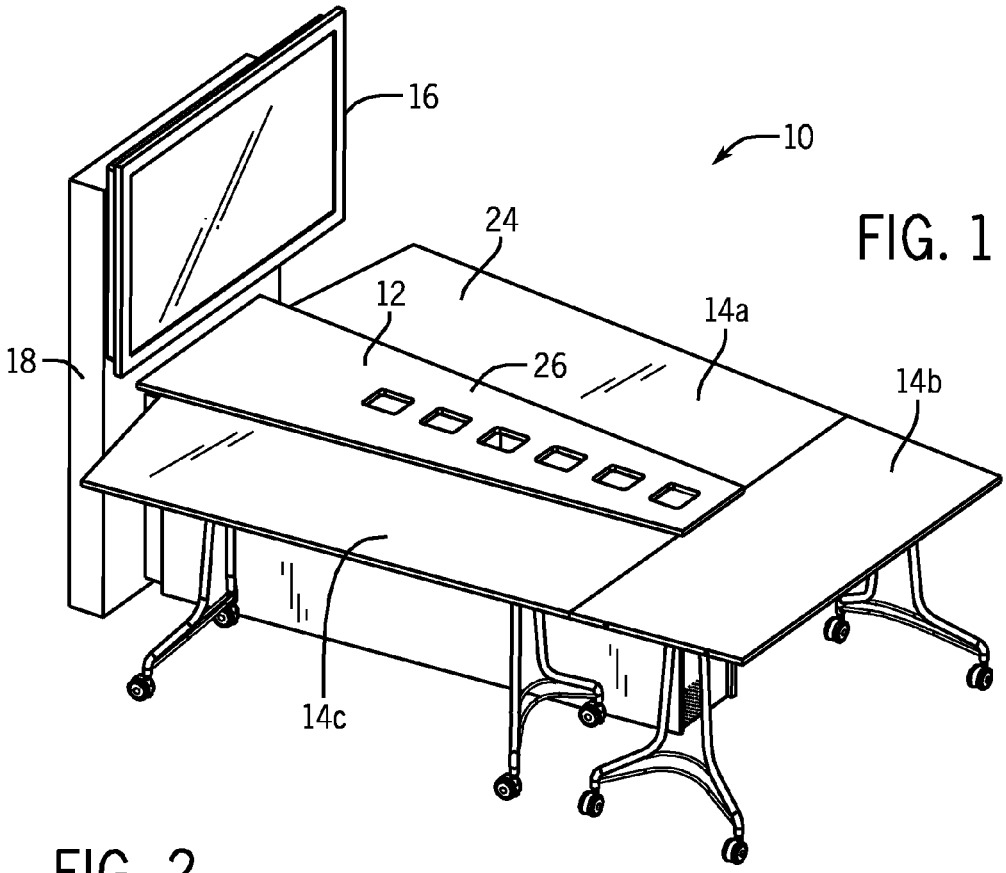
FIG. 1
FIG. 2
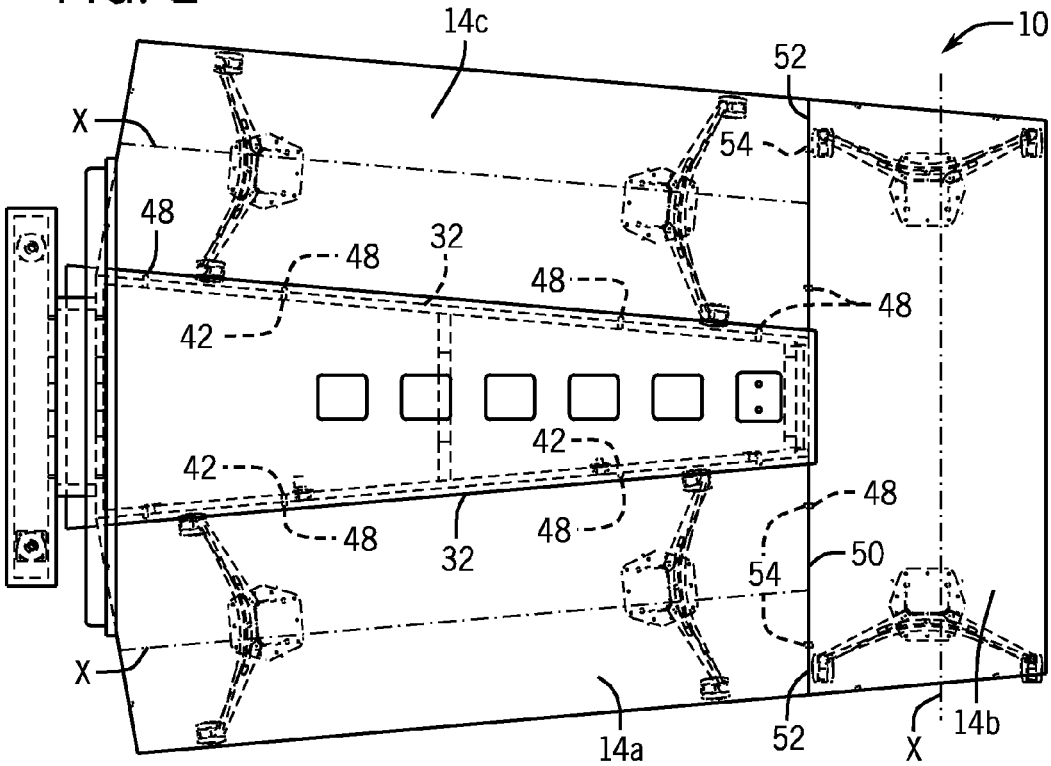

MEDIA STATION INCLUDING TECHNOLOGY BACKBONE AND MAGNETICALLY GANGED TABLE

BACKGROUND

Presently, different types of media sharing furniture exist that consist of a large single unit having a defined overall aesthetic look. Typically, this type of furniture includes seating stations for multiple persons to view a display screen.

Although several types of media sharing furniture exist, each type of furniture limits the user's flexibility from an aesthetic and planning standpoint since the unit is often large and difficult to move and reconfigure.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure generally relates to a media station that can be broken-down and reconfigured in an easy and convenient manner such that the individual parts of the media station can be used in multiple configurations. The media station of the present disclosure includes a central technology backbone that houses the computer hardware and media modules required for the type of monitor/media sharing desired. The technology backbone includes magnetic coupling members that increase the options for the different types of work tables that can be connected to the technology backbone dependent upon the user's needs and the size of the group. The ability to separate the work tables from the central technology backbone allows for greater flexibility in the styles of table used as well as the potential for cross room cohesiveness and economies of scale in unit types. When the media station is not in use, users can separate the individual work tables from the backbone and use the tables in a conventional manner in the same room. The ability to separate the tables from the technology backbone allows for flipping and nesting tables to be used to further enhance mobility and storage options.

A technology backbone for a media station is disclosed. The technology backbone has a top surface, a first support member positioned beneath the top surface and extending downward from the top surface, and a coupling member embedded in the first support member such that the coupling member does not protrude from the first support member.

A work table for use with a technology backbone having a magnetic coupling member embedded in a support member is also disclosed. The work table has a generally horizontal work surface having at least one side edge, and a magnetic coupling member embedded in the at least one side edge. When the at least one side edge of the work table is positioned adjacent the technology backbone, the magnetic coupling member embedded in the support member of the technology backbone is attracted to the magnetic coupling member embedded in the side edge of the work table. The work table is thereby held in position adjacent the technology backbone.

A complete media station for providing access to media equipment is also disclosed. The media station has a technology backbone having a top surface and a support member positioned beneath the top surface and extending downward from the top surface. The media station also has at least one work table having a work surface. A first plurality of coupling members are recessed within the support member of the technology backbone and a second plurality of coupling members are recessed within an edge of the work table. The work table is movable such that it can be positioned adjacent the technology backbone. Spacing between the first plurality of coupling members corresponds to spacing between the second plurality of coupling members, such that the first and second plurality of coupling members interact to hold the work table in position adjacent the technology backbone.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 1 is a perspective view of a media station;

FIG. 2 is a bottom view of the media station;

DETAILED DESCRIPTION

Figure 3:
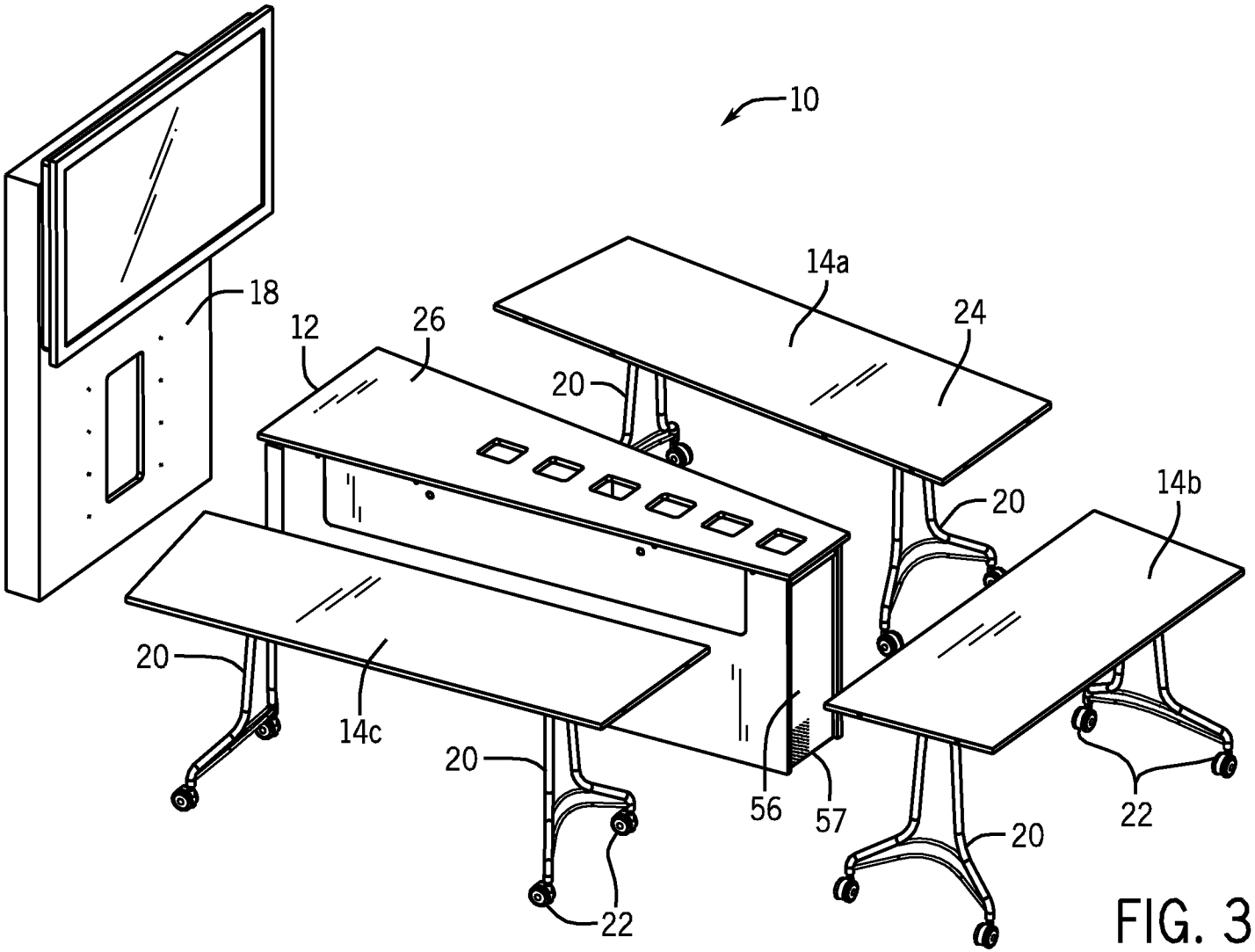
FIG. 3 is a perspective view illustrating the ability of the media station to be broken into multiple components.

In the present description, certain terms have been used for brevity, clearness and understanding. No unnecessary limitations are to be implied therefrom beyond the requirement of the prior art because such terms are used for descriptive purposes only and are intended to be broadly construed. The different systems described herein may be used alone or in combination with other systems. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

FIG. 1 illustrates a media station 10 constructed in accordance with the present disclosure. The media station 10 generally includes a central technology backbone 12, a series of work tables 14*a*, 14*b* and 14*c*, and a display 16. In the embodiment shown in FIG. 1, the display 16 is a video monitor, although other types of displays are contemplated as being within the scope of the present disclosure. In the embodiment shown in FIG. 1, the display 16 is mounted to a support stand 18. The support stand 18 may be formed from laminate and bolts onto the technology backbone 12 when the user wishes to place the media station 10 in the center of a room rather than against a wall. However, it is contemplated that the display 16 could be mounted to a wall of a room while operating within the scope of the present disclosure.

As illustrated in FIG. 3, the media station 10 can be broken down into separate, individual components such that each of the individual components can be utilized separate and apart from the combination shown in FIG. 1. As illustrated in FIG. 3, each of the work tables 14*a*, 14*b*, 14*c* can be separated from the technology backbone 12 and used separate and apart from the media station 10. Each of the individual work tables 14 includes a pair of wheeled legs 20 such that each of the work tables 14 can be moved to a different location within the facility. In the embodiment shown, each leg 20 has two wheels 22. In other embodiments, the legs 20 can have more than two wheels 22 or no wheels.

Although not shown in the embodiment of FIG. 3, it is contemplated that each of the work tables 14 could be designed to be a flipping or nesting table such that when the individual work tables 14 are separated from the entire media station 10, the work tables 14 could be stored in an efficient manner. Each of the work tables 14 includes a generally planar work surface 24. To flip and nest the work tables 14, for example, the work surface 24 of the work tables 14 can be flipped along an axis x (FIG. 2) where the underside of the work surface 24 is connected to the legs 20 of the work table 14.

Figure 4:
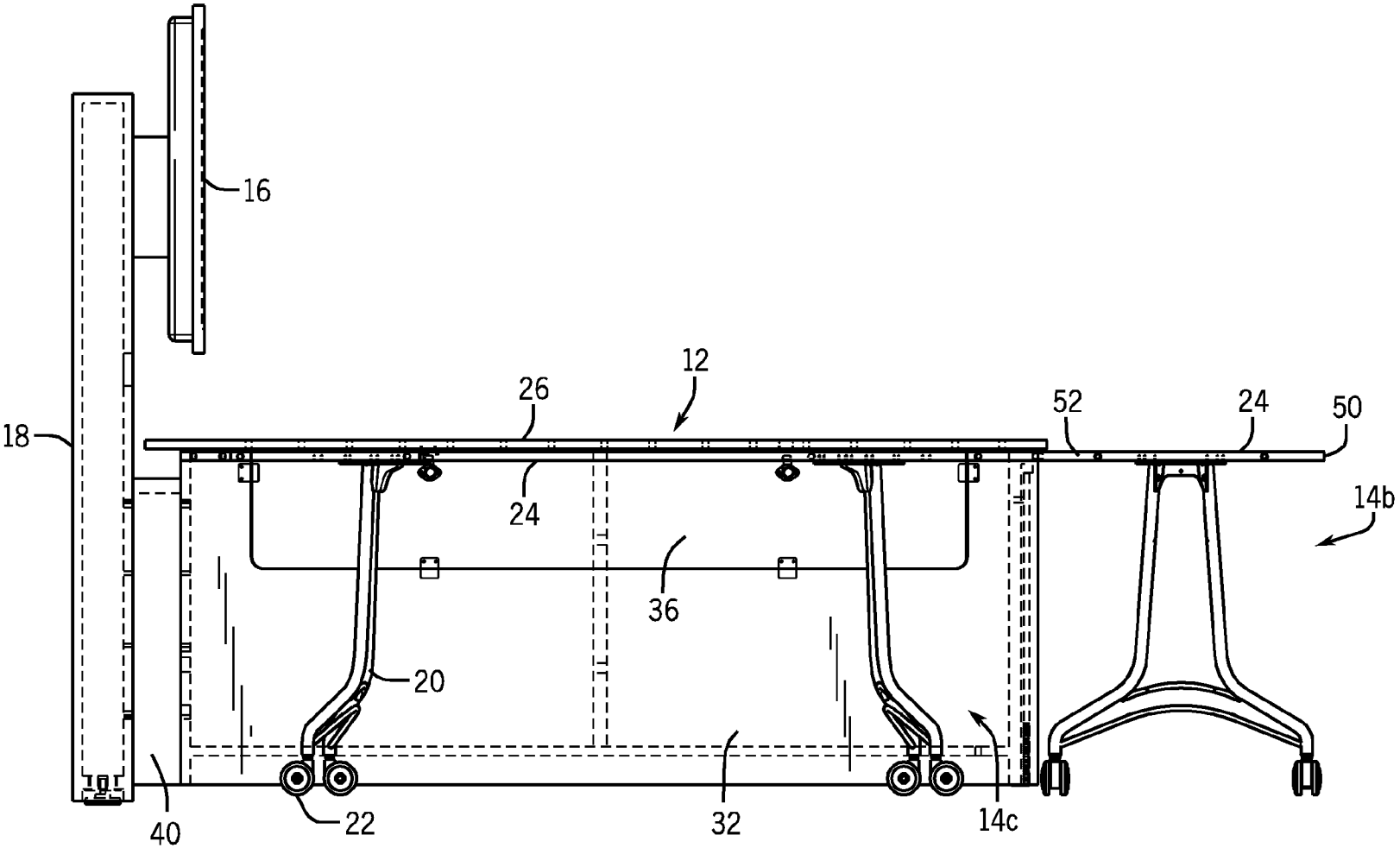
FIG. 4 is a side view of the media station.

As shown in FIG. 4, when the work tables 14 are joined to the technology backbone 12, the work surface 24 is positioned slightly below a top surface 26 of the technology backbone 12. This allows coupling members in the work tables 14 to be positioned adjacent coupling members in sidewalls 32 of the technology backbone 12, as will be described further herein below.

Figure 5:
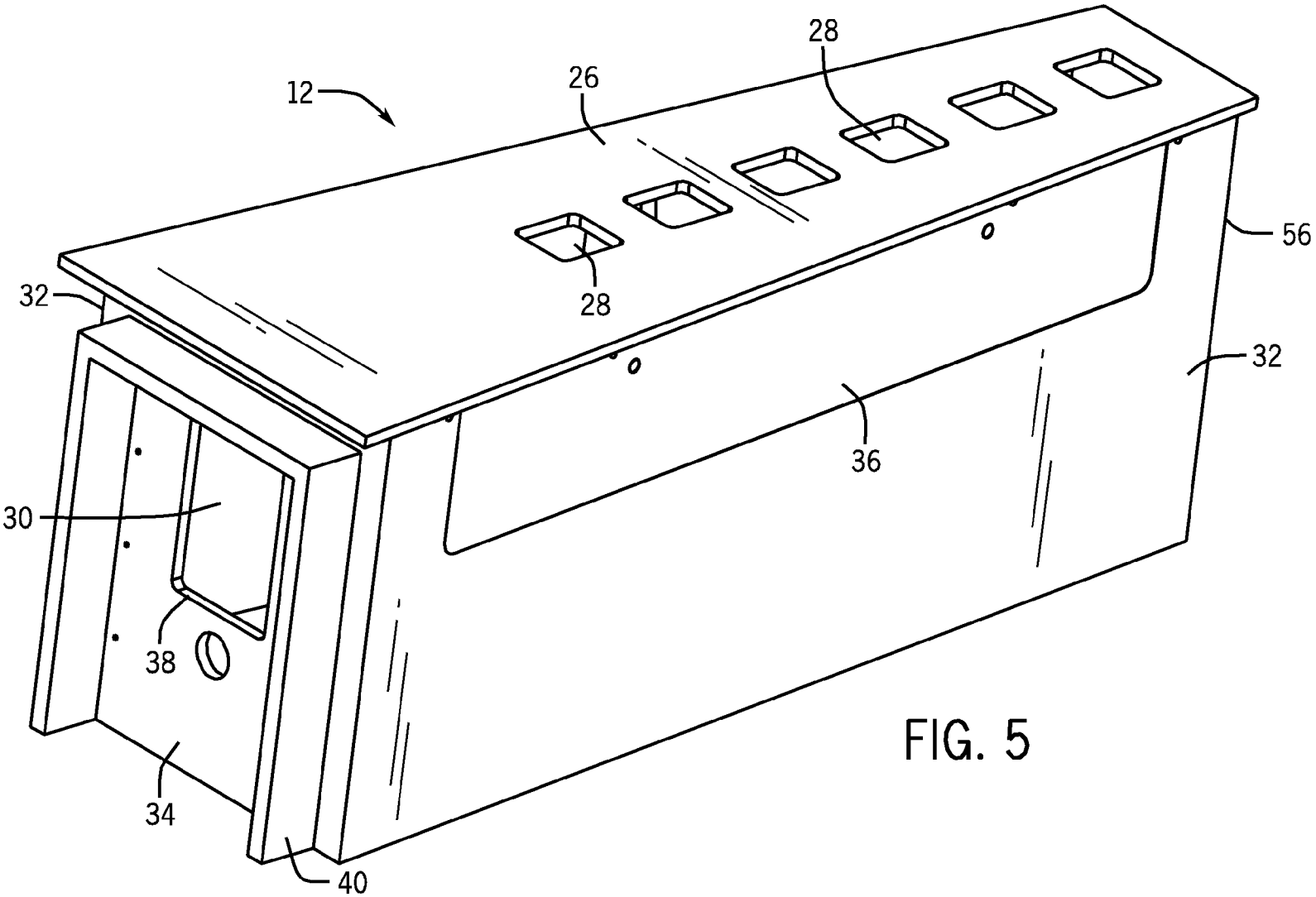
FIG. 5 is a perspective view of the central technology backbone.

FIG. 5 provides a detailed illustration of the configuration of the technology backbone 12 of the present disclosure. The technology backbone 12 generally includes a top surface 26 having a series of individual cutouts 28 that provide access to an open interior 30. The open interior 30 is designed to include various different types of electronic equipment, such as computers, projectors, internet routers, electrical supply conduits or any other type of electrical connection that may be needed by users working at the media station 10. Although the embodiment shown in FIG. 5 includes eight separate cutouts 28, it is contemplated that a fewer number of cutouts 28 could be utilized while operating within the scope of the present disclosure. In the embodiment illustrated, the technology backbone 12 is formed from laminated particle board, although other types of materials are contemplated as being within the scope of the present disclosure. The top surface 26 is formed from laminated particle board and includes the cutouts 28 that allow access the open interior 30. Each cutout 28 receives a media module that provides a point of connection for a laptop of a user seated at one of the work tables. The cutouts 28 can be sized to accept various different types of collaborative media modules. The function of the media modules can be varied by the supplier and model. Typically, the media modules allow for laptop users to plug in audio and video to be displayed (shared/toggled) on the display 16. The modules also contain access to the internet or a local area network.

The technology backbone 12 includes a support member positioned beneath the top surface 26 and extending downward from the top surface 26. The technology backbone 12 can include a second support member spaced from the first support member. For example, the first support member can be a first sidewall 32 and the second support member can be a second sidewall 32. The technology backbone 12 can include a third support member and a fourth support member extending downward from the top surface 26, wherein the third support member and the fourth support member are spaced from one another. For example, the third support member can be a front wall 56 (see FIG. 3) and the fourth support member can be a back wall 34. In other embodiments, the support members are not walls, but are legs, blocks, or any other structure capable of supporting the top surface 26.

In the embodiment shown in FIG. 5, for example, the technology backbone 12 includes a pair of sidewalls 32 that define the open interior 30 along with a back wall 34 and a front wall 56 (see FIG. 3). In other embodiments, the technology backbone 12 could include only one support member, such as one sidewall 32. In other embodiments, the technology backbone 12 could include only two support members, such as the front wall 56 and the back wall 34. Other combinations of sidewalls 32, front wall 56, and back wall 34 are contemplated within the scope of the present disclosure.

In the embodiment shown in FIG. 5, the sidewall 32 includes a removable access panel 36 that provides access to the hardware contained within the open interior 30 of the technology backbone 12. The access panel 36 is removable for access and assembly of the wiring of the table top modules and switching hardware. Once assembly is complete, the panel is locked shut to restrict access. In the preferred embodiment of this disclosure, the front wall 56 (FIG. 3) includes a decorative perforated steel panel covering a large air vent 57. The back wall 34 (FIG. 5) can include a cutout 38 that acts as an air vent and may also act as the access opening to attach the optional support stand 18.

In the embodiment shown in FIG. 5, the cutout 38 in the back wall 34 allows access to the open interior 30. The cutout 38 allows various wires and cables to pass into the technology backbone 12. In the embodiment shown in FIG. 5, an extension 40 is mounted to the back wall 34 to interface either with the support stand 18 shown in FIG. 1 or a wall of a room.

Figure 6:
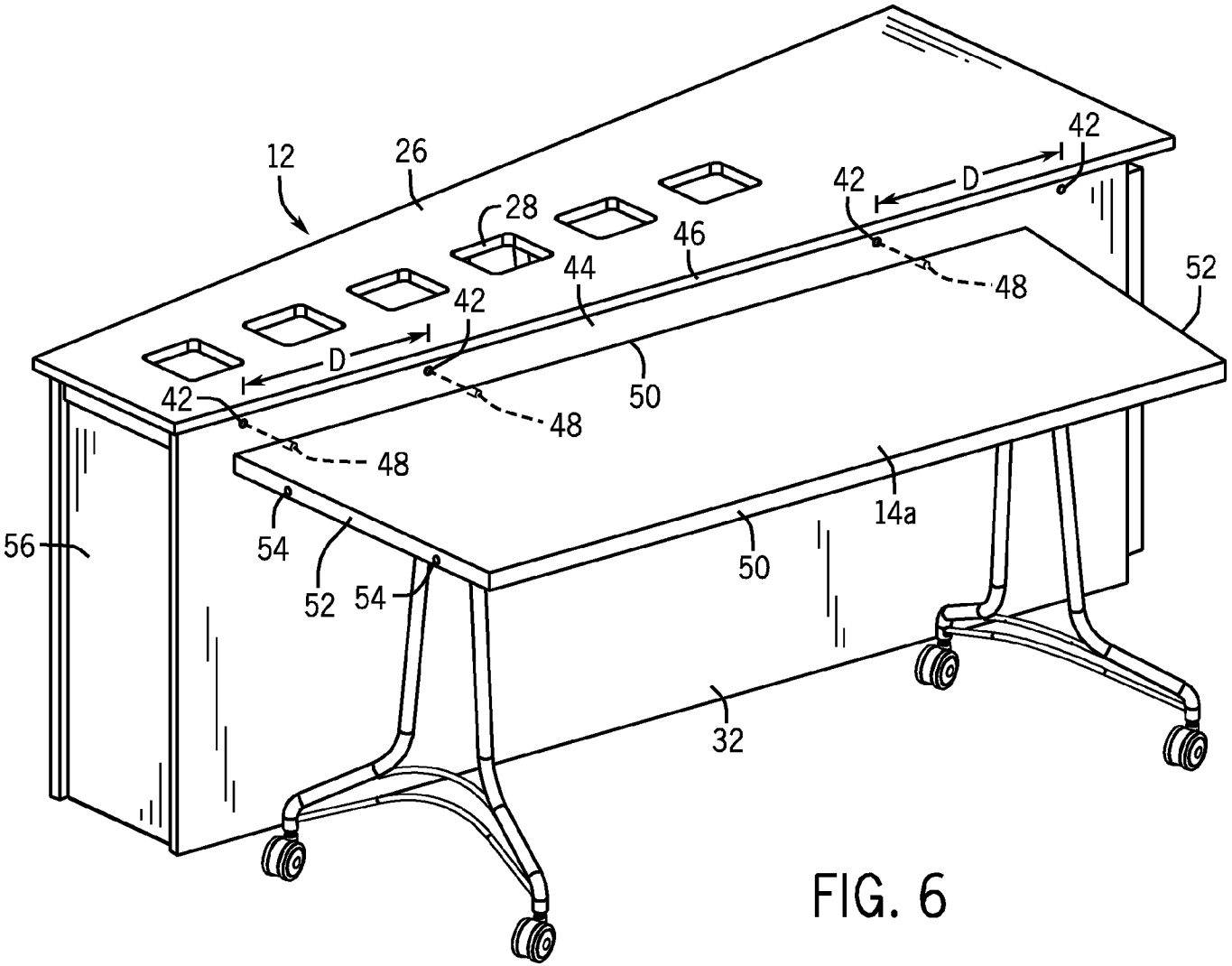
FIG. 6 is a partial perspective view illustrating the magnetic ganging between one of the work tables and the technology backbone.

Referring now to FIG. 6, the technology backbone 12 includes a coupling member embedded in the first support member such that the coupling member does not protrude from the first support member. More than one coupling member can be provided. The coupling members can be, for example, a series of permanent magnets 42 mounted into the outer surface 44 of each sidewall 32. Preferably, the permanent magnets 42 are embedded into the sidewall 32 such that they do not affect the aesthetics of the technology backbone 12 by protruding from the outer surface 44 of the technology backbone 12. The permanent magnets 42 can be positioned slightly below the top surface 26. In the embodiment shown in FIG. 6, the sidewall 32 is recessed from the outer edge 46 such that the permanent magnets 42 are recessed from the outer edge 46. The technology backbone 12 can comprise more than one coupling member, such that a first permanent magnet 42 of a first polarity (for example, positive) is embedded in the sidewall 32 and a second permanent magnet 42 of a second polarity (for example, negative) is embedded in the sidewall 32 at a distance D from the first permanent magnet 42. Embedding the permanent magnets 42 into the sidewall 32 makes the permanent magnets 42 difficult to tamper with or remove.

Figure 7:
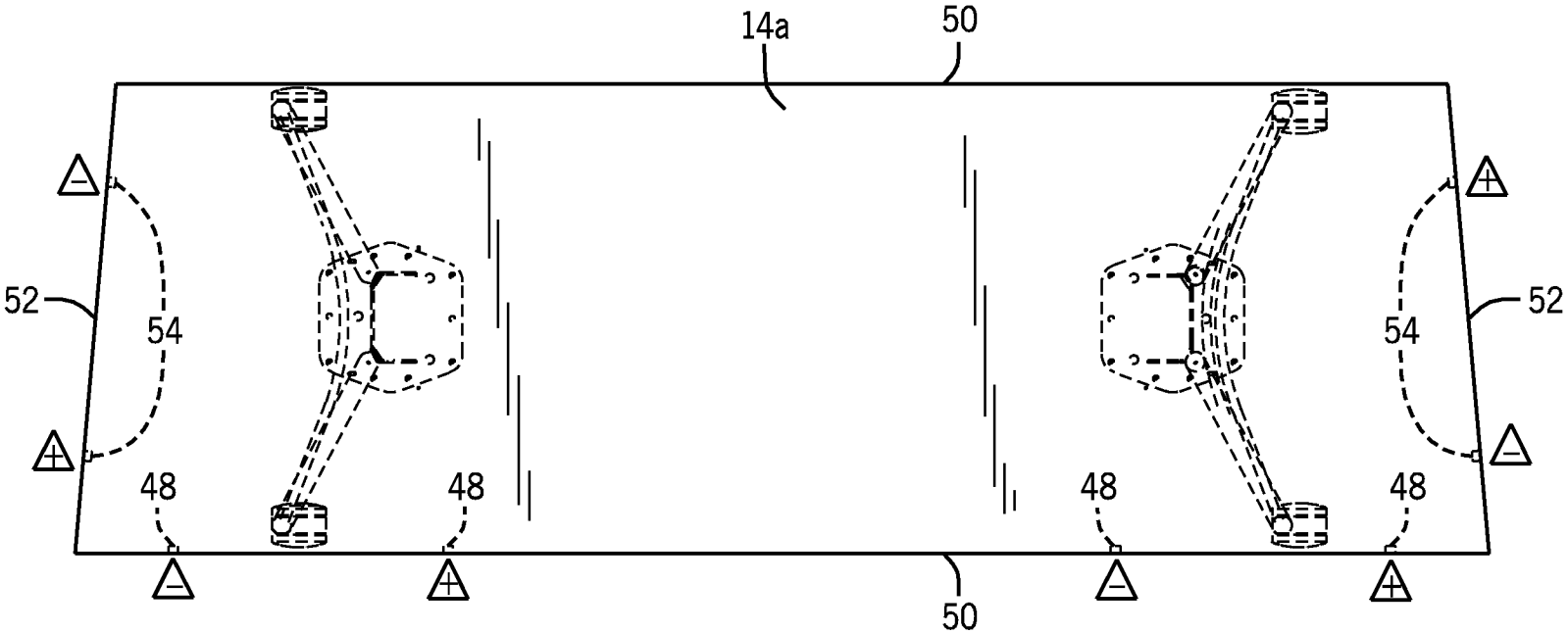
FIG. 7 is a bottom view of one of the work tables used as part of the media station.

As can be seen in FIGS. 6 and 7, each of the work tables, such as work table **14*a*, has edges, such as side edges 50 and end edges 52. The work table 14*a* includes four permanent magnets 48 recessed into the side edge 50. As illustrated in FIG. 7, the permanent magnets 48 have alternating polarities such that two positive magnets and two negative magnets are recessed into the side edge 50. In the embodiment shown in FIG. 7, only one of the side edges 50 includes the permanent magnets 48. However, it is contemplated that the opposite side edge 50 could also include permanent magnets 48** while operating within the scope of the present disclosure.

In the embodiment shown in FIG. 7, both of the end edges 52 also include a pair of permanent magnets 54. The permanent magnets 54 formed in the end edges 52 also have opposite polarities for reasons as will be described in detail below.

Referring back to FIG. 6, when the work table 14*a* is positioned adjacent to the technology backbone 12, the permanent magnets 42 formed in the technology backbone 12 engage the permanent magnets 48 formed in the work table 14*a*. As can be understood from FIG. 6, the spacing between the permanent magnets 42 on the technology backbone 12 corresponds to the spacing between the permanent magnets 48 formed in the work table 14*a*. Thus, the work table 14*a* is held in contact with the sidewall 32 of the technology backbone 12 through the interaction between the permanent magnets 42, 48.

Referring now back to FIG. 2, when the work tables 14*a*, 14*b*, and 14*c* and technology backbone 12 are brought together to form the media station 10, the permanent magnets 48 formed in the side edges 50 of the work tables 14*a*, 14*c* engage the permanent magnets 42 formed in the pair of sidewalls 32 of the technology backbone 12. In the configuration shown, the permanent magnets 48 formed in the side edge 50 of the work table 14*b* engage the end edge magnets 54 formed in the end edges 52 of the work tables 14*a* and 14*c*. As can be understood in FIG. 2, the positioning of the permanent magnets 54 in the end edges 52 allows the work tables 14*a*, 14*b*, 14*c* to interact with each other to define the media station 10.

The media station 10 therefore includes a technology backbone 12 having a top surface 26 and a support member positioned beneath the top surface 26 and extending downward from the top surface 26. The media center 10 also includes a work table 14 having a work surface 24. A first plurality of coupling members are recessed within the support member of the technology backbone 12. A second plurality of coupling members are recessed within an edge of the work table 14. The work table 14 is movable such that it can be positioned adjacent the technology backbone 12. Spacing between the first plurality of coupling members corresponds to spacing between the second plurality of coupling members, such that the first and second plurality of coupling members interact to hold the work table 14 in position adjacent the technology backbone 12. More specifically, a pair of permanent magnets 42 of the first plurality of coupling members are recessed within the support member (such as the sidewall 32) and a pair of permanent magnets 48 of the second plurality of coupling members are recessed within the edge of the work surface 24. The pair of magnets 42 in the sidewall 32 have opposite polarities from one another and the pair of magnets 48 in the edge have opposite polarities from one another. The edge of the work table 14 is positioned adjacent the technology backbone 12 such that the magnets 42 in the sidewall 32 are attracted to the magnets 48 in the edge, thereby holding the work table 14 in position adjacent the technology backbone 12.

Referring now back to FIG. 3, the media station 10 can be easily separated into its individual components, as illustrated, by simply pulling each of the work tables 14*a*, 14*b*, and 14*c* away from the technology backbone 12 with sufficient force to break the magnetic forces created between the magnets described previously with reference to FIG. 2.

Figure 8A:
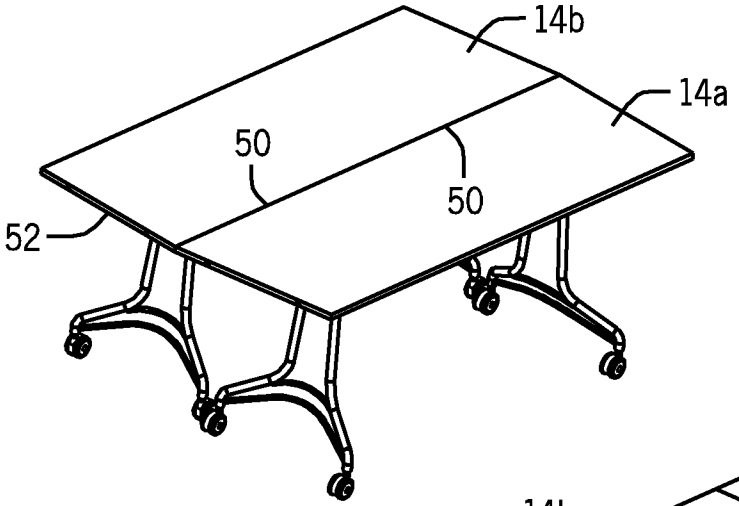
FIG. 8*a* is a perspective view illustrating the magnetic ganging of two individual work tables.
Figure 8B:
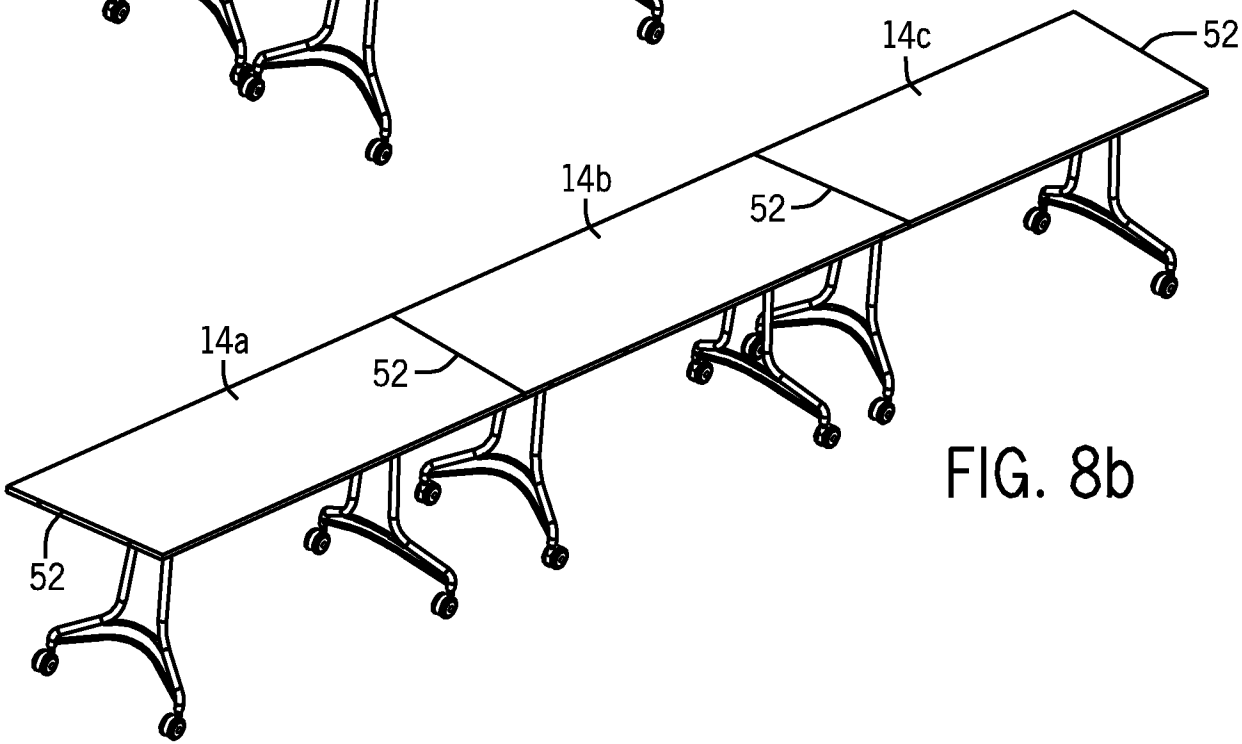
FIG. 8*b* is a second, alternate configuration for the magnetic ganging of the work tables.

Referring now to FIGS. 8*a* and 8*b*, the individual work tables 14*a*, 14*b*, 14*c* can be used separate from the media station 10 and ganged to each other through the interaction between the magnets formed in the end edges 52 and the side edges 50 of each individual work table 14*a*-14*c*. In the embodiment shown in FIG. 8*a*, two work tables 14*a*, 14*b* are joined to each other along their respective side edges 50. In the embodiment of FIG. 8*b*, three of the work tables 14*a*, 14*b* and 14*c* are joined to each other along their respective end edges 52. Although two different configurations for the work tables 14*a*, 14*b*, 14*c* are shown in FIGS. 8*a* and 8*b*, it is contemplated that the work tables 14 could be joined in other configurations while operating within the scope of the present disclosure. As discussed above, the magnets formed in the side edges 50 and end edges 52 allow the tables to be magnetically ganged either to each other or to the central technology backbone 12.

As described above, each of the work tables 14*a*-14*c* can include eight permanent magnets 48, 54 formed along one or both of the side edges 50 and one or both of the end edges 52. The permanent magnets 48, 54 can be embedded beneath an edge treatment or laminate surface material to provide a visually pleasing appearance. Setting the permanent magnets 48, 54 beneath an edge treatment makes the permanent magnets 48, 54 impossible to tamper with or be removed. As described, the permanent magnets 48, 54 also provide a fail-safe release if the work tables 14*a*-14*c* are impacted or run into by an unsuspecting person. Although permanent magnets 48 are shown embedded into only one of the side edges 50, it is contemplated that the permanent magnets 48 could be embedded into both side edges 50 while operating within the present disclosure. It is also contemplated that fewer than eight permanent magnets 48, 54 could be used.

The present disclosure is not meant to be limited to coupling members that comprise permanent magnets. For example, the coupling members could also comprise hook and loop fasteners, latches, electromagnets, and any other coupling members capable of coupling the technology backbone 12 to the work tables 14*a*-14*c* and the work tables 14*a*-14*c* to one another, according to the above description. Further, it is to be understood that fewer or more than three work tables can be ganged to one another (i.e., to another work table 14) or to the technology backbone 12. For example, a fourth work table 14 could be provided adjacent the back wall 34 of the technology backbone 12. In other embodiments, two work tables 14 can be provided along each sidewall 32 of the technology backbone 12. The configurations shown herein are therefore not intended to limit the scope of the appended claims.

What is claimed is:

1. A media station for providing access to media equipment, the media station comprising:

a technology backbone having a top surface and a support member positioned beneath the top surface and extending downward from the top surface;

a first work table having a first work surface;

a second work table having a second work surface;

a first plurality of coupling members recessed within the support member of the technology backbone;

a second plurality of coupling members recessed within a side edge of the first work table;

a third plurality of coupling members recessed within an end edge of the first work table and;

a fourth plurality of coupling members recessed within a side edge of the second work table;

wherein the first and second work tables are movable such that they can be positioned adjacent the technology backbone;

wherein spacing between the first plurality of coupling members corresponds to spacing between the second plurality of coupling members, such that the first and second plurality of coupling members interact to hold the side edge of the first work table in position adjacent the technology backbone; and wherein spacing between the third plurality of coupling members corresponds to spacing between the fourth plurality of coupling members such that the third and fourth plurality of coupling members interact to hold the end edge of the first work table to the side edge of the second work table, thereby positioning the second work table adjacent both the first work table and the technology backbone.

2. The media station of claim 1, wherein the first and second work tables are supported by wheeled legs.

3. The media station of claim 1, wherein when the first and second work tables are positioned adjacent the technology backbone, the first and second work surfaces of the first and second work tables are positioned below the top surface of the technology backbone.

4. The media station of claim 1, wherein the second, third, and fourth pluralities of coupling members are covered by a layer of laminate surface material.

5. The media station of claim 1, wherein the second, third and fourth pluralities of coupling members are covered by an edge treatment.

6. The media station of claim 1, wherein the coupling members are permanent magnets.

7. The media station of claim 6, wherein at least a pair of permanent magnets are recessed within the support member and at least a pair of permanent magnets are recessed within the side edge of the first work table.

8. The media station of claim 7, wherein the pair of permanent magnets in the support member have opposite polarities from one another and the pair of permanent magnets in the side edge have opposite polarities from one another; and wherein the side edge of the first work table is positioned adjacent the technology backbone such that the permanent magnets in the support member are attracted to the permanent magnets in the side edge, thereby holding the first work table in position adjacent the technology backbone.

9. The media station of claim 1, wherein the side edge of the first work table has a greater dimension than the end edge of the first work table.

10. The media station of claim 1, wherein the first plurality of coupling members comprises two pairs of permanent magnets, each pair of permanent magnets comprising a first magnet with a first polarity for engaging with a magnet of an opposite polarity in the second plurality of coupling members and a second magnet with a second polarity for engaging with a magnet of an opposite polarity in the second plurality of coupling members.

11. A work table for use with a technology backbone having a pair of magnetic coupling members embedded in a support member, the work table comprising:

a generally horizontal work surface having at least one side edge and at least one end edge; and a first pair of magnetic coupling members embedded in the at least one side edge and a second pair of magnetic coupling members embedded in the at least one end edge;

wherein when the at least one side edge of the work table is positioned adjacent the technology backbone, the pair of magnetic coupling members embedded in the support member of the technology backbone is attracted to the first pair of magnetic coupling members embedded in the side edge, thereby holding the work table in position adjacent the technology backbone; and wherein when a second work table is positioned adjacent the technology backbone, the second pair of magnetic coupling members is attracted to a third pair of magnetic coupling members embedded in a side edge of the second work table, thereby holding the second work table in position adjacent the first work table and the technology backbone.

12. The work table of claim 11, wherein the first pair of magnetic coupling members holds the work table in position adjacent the third pair of magnetic coupling members embedded in the side edge of the second work table when the two work tables are disconnected from the technology backbone and positioned adjacent one another along their respective side edges.

13. The work table of claim 11, wherein the second pair of magnetic coupling members holds the work table in position adjacent the second work table, the second work table having a fourth pair of magnetic coupling members embedded in an end edge, when the two work tables are disconnected from the technology backbone and positioned adjacent one another along their respective end edges.

14. The media station of claim 11, wherein the side edge of the work table has a greater dimension than the end edge of the work table.

* * * * *